US006206216B1

(12) United States Patent
Stalions

(10) Patent No.: US 6,206,216 B1
(45) Date of Patent: Mar. 27, 2001

(54) CHILD-RESISTANT CAP

(75) Inventor: Stephen E. Stalions, Chandler, AZ (US)

(73) Assignee: Top Seal Corporation, Phoenix, AZ (US)

( * ) Notice: Subject to any disclaimer, the term of this patent is extended or adjusted under 35 U.S.C. 154(b) by 0 days.

(21) Appl. No.: 09/360,525

(22) Filed: Jul. 26, 1999

(51) Int. Cl.[7] ..... B65D 55/02
(52) U.S. Cl. ..... 215/220
(58) Field of Search ..... 215/217, 218, 215/219, 220

(56) References Cited

U.S. PATENT DOCUMENTS

| | | | | |
|---|---|---|---|---|
| 3,622,027 | * | 11/1971 | Maki | 215/220 |
| 4,284,201 | | 8/1981 | Nixon . | |
| 4,319,690 | | 3/1982 | Birrell et al. . | |
| 4,330,067 | | 5/1982 | Deussen . | |
| 4,385,705 | | 5/1983 | Kusz . | |
| 4,394,916 | | 7/1983 | Smalley . | |
| 4,433,789 | | 2/1984 | Gibilisco . | |
| 4,480,759 | | 11/1984 | Behrens et al. . | |
| 4,523,688 | * | 6/1985 | Puresevic et al. | 215/220 |
| 4,527,701 | * | 7/1985 | Schaubeck | 215/220 |
| 4,609,114 | | 9/1986 | Roy . | |
| 4,673,095 | | 6/1987 | Puresevic et al. . | |
| 4,723,685 | | 2/1988 | Fillmore et al. . | |
| 4,957,210 | | 9/1990 | Kusz . | |
| 4,997,096 | | 3/1991 | Kusz . | |
| 4,998,632 | | 3/1991 | Morris, Sr. . | |
| 5,005,718 | * | 4/1991 | Buono | 215/220 |
| 5,184,739 | | 2/1993 | Kusz . | |
| 5,188,251 | | 2/1993 | Kusz . | |
| 5,261,548 | | 11/1993 | Barker et al. . | |
| 5,280,842 | * | 1/1994 | Koo | 215/220 |
| 5,316,161 | | 5/1994 | Gargione . | |
| 5,433,329 | | 7/1995 | Weinstein . | |
| 5,484,070 | | 1/1996 | Graham . | |
| 5,588,595 | | 12/1996 | King . | |
| 5,590,799 | | 1/1997 | King . | |
| 5,611,443 | | 3/1997 | King . | |
| 5,676,268 | | 10/1997 | King . | |
| 5,678,712 | * | 10/1997 | Rios | 215/220 |
| 5,732,836 | | 3/1998 | Barker et al. . | |
| 5,743,419 | | 4/1998 | King . | |
| 5,762,215 | | 6/1998 | Ogden . | |

* cited by examiner

*Primary Examiner*—Stephen K. Cronin
(74) *Attorney, Agent, or Firm*—Snell & Wilmer L.L.P.

(57) ABSTRACT

A multiple-piece cap assembly which is child-resistant, yet which, because of radial contact between the caps, can be more easily opened by persons such as the elderly, arthritic, disabled and infirm adults. In an exemplary embodiment of the present invention, removal of the cap assembly requires two simultaneous motions such as, for example, turning the cap and pushing downward to engage lug and ramp projections on the caps. In this embodiment of the present invention, the two caps engage each other by a ramp and lug configuration in order to fasten and remove the cap assembly, wherein the lugs and ramps engage one another substantially by "line" contact and/or "surface-to-surface" contact. The cap of the present invention thus requires less force in at least one direction of the concurrent motions in order to remove the cap assembly, thus making the cap assembly child-resistant, yet senior-friendly.

9 Claims, 7 Drawing Sheets

CHILD-RESISTANT CAP

BACKGROUND OF THE INVENTION

1. Technical Field

The present invention relates generally to child-resistant closures, and more particularly to child-resistant closures with multiple caps which engage by radial contact offering advantages over the prior art by enabling easier opening, yet which remain child-resistant.

2. Background of the Invention

Today, child-resistant closures are very important for the safety of children. As used herein, use of the term "child-resistant closure" is consistent with 16 CFR 1700 and refers generally to the inability of a younger child's or person with a younger child's strength and/or manual dexterity to open a closure 85% of the time within a given amount of time without a demonstration of how to open the closure, or 80% of the time with such a demonstration.

There are presently many different child-resistant closure designs. Of the most common closures, those which have proven to work well are caps which require two or more concurrent motions in order to open them. For example, one such design is the "push-and-turn" closure. Generally, such closures can only be opened by simultaneously pushing downward on the cap while turning it.

Examples of "push-and-turn" designs are disclosed in U.S. Pat. No. 4,319,690, issued to Stewart H. Birrell and Peter Hedgewick on Mar. 16, 1982, and U.S. Pat. No. 4,394,916, issued to Ned J. Smalley on Jul. 26, 1983. These patents describe a typical two-piece, ramp and lug design. Essentially the closure comprises an inner cap and an outer cap which are rotatably attached to one another. A plurality of lugs on one cap project towards a plurality of corresponding ramps on the opposite cap. Generally, the ramps and lugs engage each other when turned in a fastening direction such that the two caps turn in tandem.

However, when the cap is merely rotated in an "unfastening" direction, the lugs tend to slide over the ramps. The outer cap turns freely from the inner cap, and the inner cap remains fastened to the container. In order to open the cap, the outer cap must be pushed downward in order to counteract the tendency of the lugs to slide over the ramps while the cap is being turned.

These cap designs tend to work well because children lack the strength, cognitive ability, dexterity and/or motor skills to make the required motions simultaneously. The dual motion closures thus prove to be not readily openable by children, and therefore effectively achieve the goal of preventing children from opening the container on which the closure is attached.

However, though the many child-resistant closures are effective at preventing children from opening them, the closures have also proven to be very difficult for others lacking strength and/or manual dexterity skills, though not necessarily to the same extent of a child. For example, seniors and others suffering from arthritis, loss of strength and other similar infirmities and disabilities may find such closures difficult to open. In the following description, closures which present such difficulties (e.g., 10% or more of seniors cannot open the closure within a given time) will be referred to generally as "senior-resistant" while closures which can be opened by such will be referred to generally as "senior-friendly".

Senior resistant closures are troublesome as quite often, seniors are the very persons in need of the contents (e.g., medication) sealed by the closure. However, because they may be arthritic or have a general lack of strength, coordination, dexterity, etc., seniors (and disabled or infirm) are not able to open the closure. In particular, though they may be able to make the simultaneous motions required to open the closure, the lugs typically engage the ramps through the range of contact at only one point or region of contact, away from the outer edge of the cap. This "point contact" coupled with the location of that point require that more torque and/or downward force be applied in order to remove the cap. Seniors often do not have sufficient strength or dexterity to both supply the extra torque required and push downward on the cap in order to remove the cap assembly. The closure thus becomes, in effect, senior-resistant as well as child-resistant.

Designers and manufacturers of child-resistant closures have long recognized the difficulty seniors have in accessing containers with child-resistant closures. However, no designs which overcome the effects of "point contact" have been developed, and similarly, no other designs which adequately prevent children from opening the closures, yet which allow seniors to open them have been developed.

For example, attempts to address such difficulties, so-called "arthritis caps", have been developed. These caps are designed to be more easily opened by arthritics. However, the caps suffer from being more readily openable by children as well. This is generally because as the closures became easier for seniors to open, to some extent, it becomes easier for children to open the closures as well. Such a result is unacceptable as preventing children from opening the closures outweighs the desire for seniors to have the ability to open the closure. Thus, true child-resistant caps remain a necessity.

Accordingly, a child-resistant closure which overcomes the drawbacks of point contact, which children cannot remove, yet which seniors can more readily remove is therefore desirable.

SUMMARY OF THE INVENTION

The present invention provides a child-resistant, multiple-piece cap assembly which has substantially radial contact between the caps and allows seniors to more readily remove the assembly. In an exemplary embodiment of the present invention, rem oval of the cap assembly requires two simultaneous motions such as, while turning the cap, pushing downward to engage various projections on the caps. For example, in one embodiment the two caps engage each other by a ramp and lug configuration in order to fasten and remove the cap assembly, wherein the lugs and ramps engage one another substantially radially by "line" and/or "surface-to-surface" contact. The cap of this embodiment thus requires less force in at least one direction of the concurrent motions in order to remove the cap assembly, thereby leaving the cap assembly child-resistant, yet making it senior-friendly.

BRIEF DESCRIPTION OF THE DRAWINGS

Additional aspects of the present invention will become evident upon reviewing the non-limiting embodiments described in the specification and the claims taken in conjunction with the accompanying figures, wherein like numerals designate like elements, and:

DETAILED DESCRIPTION OF PREFERRED EXEMPLARY EMBODIMENTS

The following descriptions are of preferred exemplary embodiments only, and are not intended to limit the scope, applicability, or configuration of the invention in any way. Rather, the following description merely provides a convenient illustration for implementing a preferred embodiment of the invention. For example, various changes may be made to the function and arrangement of elements described in the preferred embodiments without departing from the spirit and scope of the invention as set forth in the appended claims. In addition, while the following detailed description is directed to push-and-turn and ramp-and-lug child-resistant closures, the present invention is not limited to such designs and is similarly applicable to closures utilizing other means of "child-resistance", and cap configurations such as those including more than two caps or those which employ "interlocking" child-resistant structures.

Further, though the following description of preferred embodiments of the present invention is directed to a child-resistant closure which senior citizens have less difficulty removing, yet which remain child-resistant, similarly, other adult cross-sections of society, such as the disabled, infirm or arthritic adults, will likewise be able to remove the closure.

Generally, in accordance with one embodiment of the present invention, a child-resistant closure is provided which is suitably comprised of a cap assembly and a mechanism or structure which makes the assembly child-resistant, yet which is substantially more senior-friendly than previously known caps.

For example, according to one aspect of this embodiment, the mechanism may suitably comprise a set of projections which allow engagement between caps of a multiple-piece cap assembly by substantially radial contact between those projections throughout the range of relative motion between the projections. However, one skilled in the art will realize that in various alternative embodiments, other mechanisms or structures which make a cap assembly suitably child-resistant can also provide substantial radial contact and may also allow the assembly to remain more senior-friendly, thereby still falling within the spirit and scope of the present invention.

Figure 1:
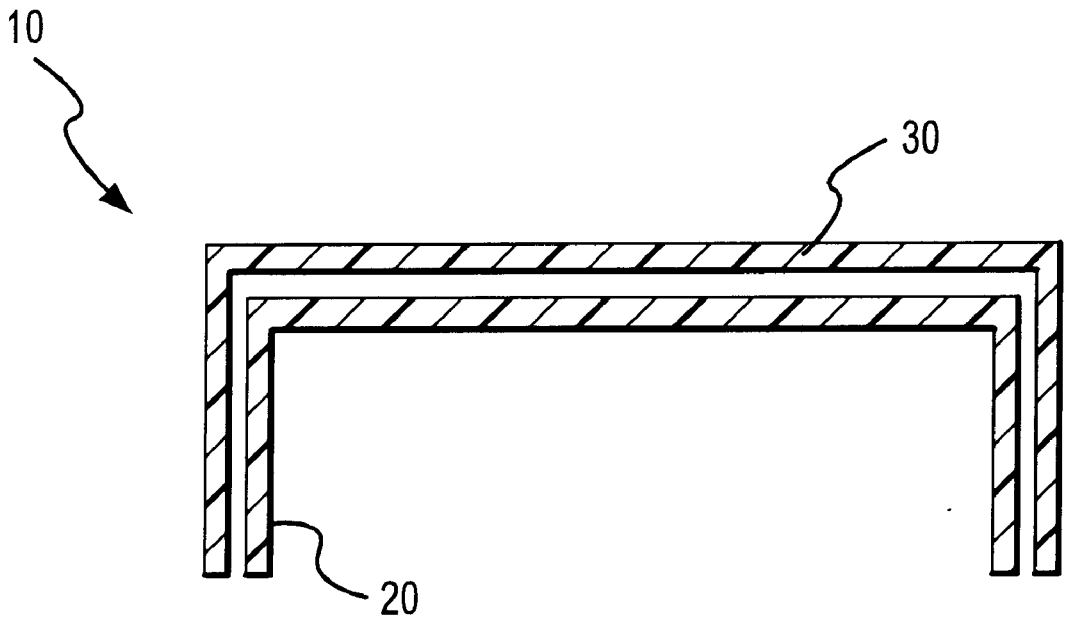
FIG. 1 is a cross-sectional view of an inner cap retained in an outer cap of a child-resistant cap assembly.

Accordingly, with reference to FIG. 1, in accordance with an exemplary embodiment of the present invention, a child-resistant cap assembly 10 is suitably comprised of two caps, an inner cap 20 and an outer cap 30. However, in accordance with various alternative embodiments, cap assembly 10 is not limited to two caps, and may instead be configured with only one cap, or alternatively, with one or more additional caps.

In the present exemplary embodiment, inner cap 20 and outer cap 30 are both formed from a plastic material such as polyvinyl chloride (PVC), though differing materials such as low or high density polyethylene, polypropylene, polystyrene, polyester teraphthalate (PET), nylon and the like may be similarly substituted. Further, according to various alternative aspects of the present invention, inner cap 20 and outer cap 30 may each suitably be formed from differing materials. For example, it may be desirable to form outer cap 30 from a more rigid material than inner cap 20 so that outer cap 30 is more easily gripped by the user or so that inner cap 20 has the ability to resiliently deform as desired when cap assembly 10 is used.

Figure 2A:
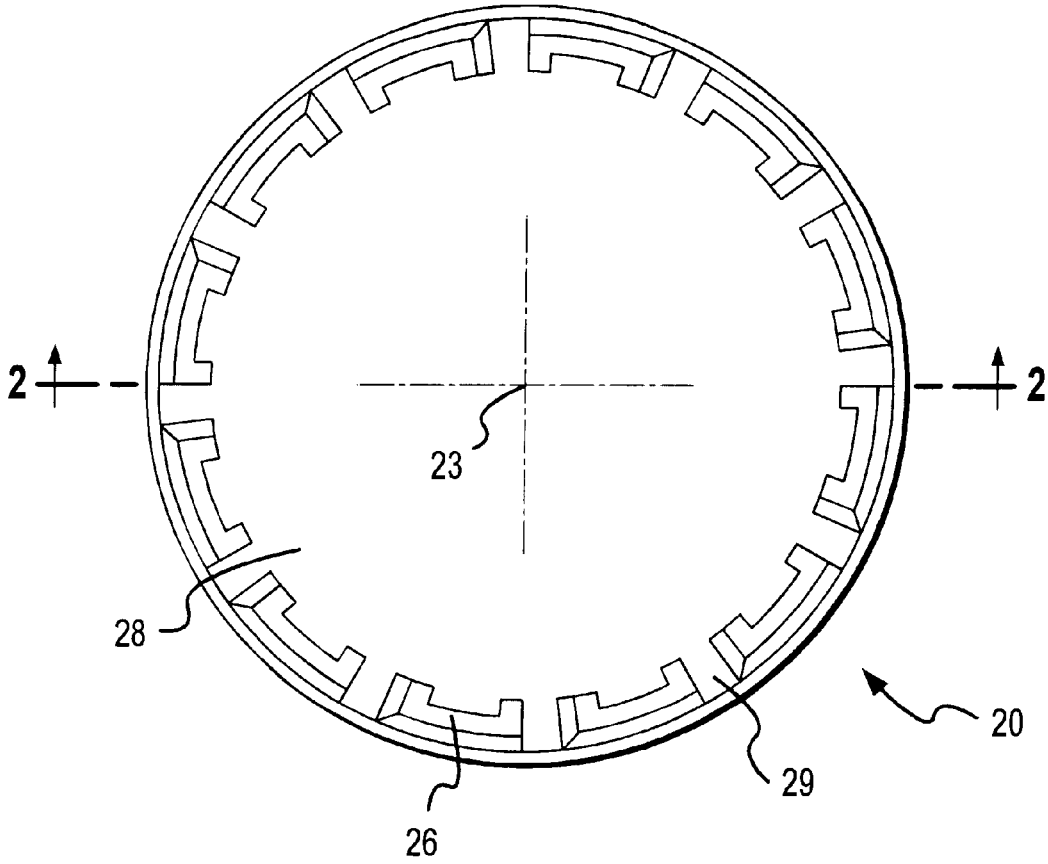
FIG. 2*a* is a top view of an inner cap of a child-resistant cap assembly.
Figure 2B:
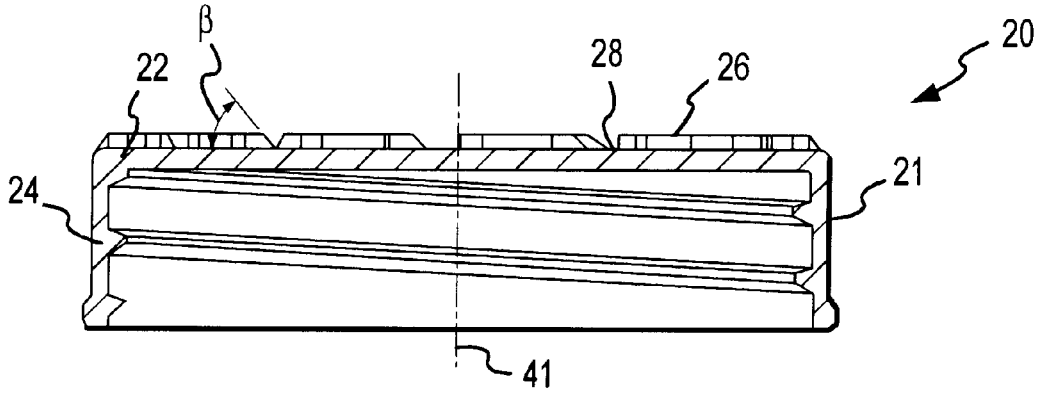
FIG. 2*b* is a cross-sectional side view of an inner cap of a child-resistant cap assembly.

With reference to FIG. 2, inner cap 20 is suitably comprised of a first circular top 22 and a first annular extending side wall 24. First side wall 24 is suitably configured to be threadably mounted on a container. However, according to various alternative aspects of the present invention, cap assembly 10, inner cap 20 and/or first side wall 24 may be configured to mount on the container in a variety of alternative configurations.

In accordance with various aspects of the present invention, and with continuing reference to FIG. 2, inner cap 20 is suitably configured with at least one ramp 26. In the present exemplary embodiment, inner cap 20 is configured with twelve ramps 26. Ramps 26 are suitably located on a top surface 28 of inner cap 20, though, according to various alternative aspects and embodiments of the present invention, ramps 26 may be located on another surface of inner cap 20 such as an outside surface 21 of first side wall 24.

In accordance with one aspect of the present invention, ramps 26 are suitably configured annularly at evenly spaced intervals, in proximity to an outer edge 29 of first circular top 28. However, according to various alternative aspects, ramps 26 may be situated in varying configurations such as, for example, proximate to a center 23 of first circular top 28, at uneven intervals, staggered radially, or other similar configurations.

According to an exemplary embodiment of the present invention and as will be described in further detail below, ramps 26 are suitably configured such that outer cap 30 can engage inner cap 20 by radial contact in the form of "line" or "surface-to-surface contact" at substantially more points of relative rotation of inner cap 20 and outer cap 30 when unfastening cap assembly 10 than heretofore known. For example, with reference to FIG. 3, ramp 26 may be suitably configured with a first off drive surface 25 and a first on drive surface 27.

In accordance with one aspect of a preferred embodiment of the present invention to obtain line contact, first off drive surface 25 is suitably configured as a first complex angle a. First complex angle $\alpha$ is suitably formed by at least two angles relative to top surface 28 and center 23 of inner cap 20. According to the present aspect of the current embodiment, first complex angle $\alpha$ is formed by a first varying angle $\beta$ and a second fixed angle $\delta$. As described in further detail below, first varying angle $\beta$ varies along first off drive surface 25 such that radial contact between ramp 26 and lug 36 is maintained throughout the range of relative motion between inner cap 20 and outer cap 30.

Figure 3A:
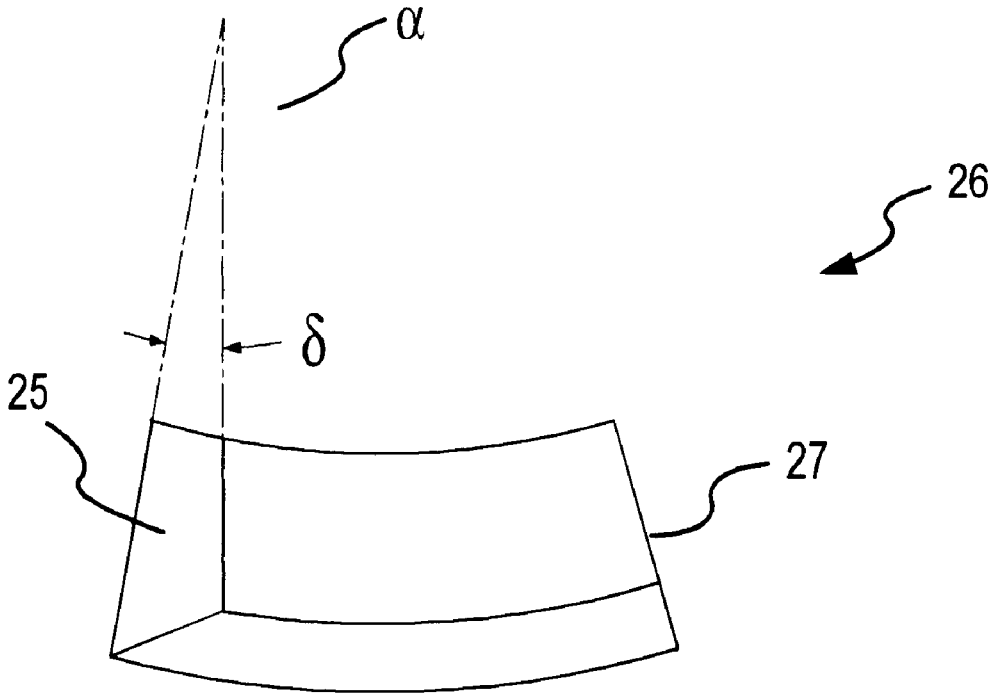
FIG. 3*a* is a top view of a ramp of a child-resistant cap assembly.
Figure 3B:
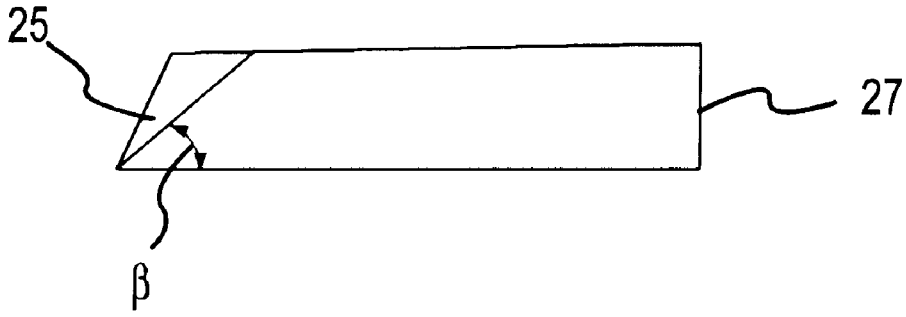
FIG. 3*b* is a side view of a ramp of a child-resistant cap assembly.

With continuing reference to FIG. 3, first varying angle $\beta$ is preferably formed as a varying acute angle with top surface 28 of inner cap 20. That is, first varying angle $\beta$ changes such that, as described below, as lug projection 36 moves over ramp 26, lug 36 and ramp 26 remain in radial contact, i.e. first varying angle $\beta$ changes as a function of distance across first off drive surface 25.

Second angle $\delta$ is suitably formed such that any line horizontal to top surface 28 of inner cap 20 and which engages in radial contact with first off drive surface 25 will pass through a center line 41 of first circular top 28, i.e., a radial line.

Figure 4:
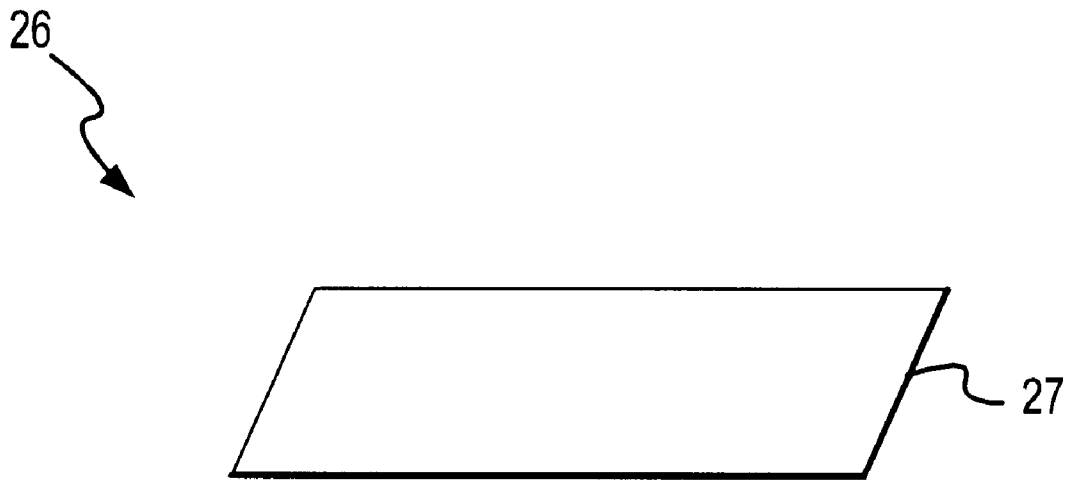
FIG. 4 is an alternative embodiment of a ramp of a child-resistant cap assembly.

Now, still referring to FIG. 3, according to another aspect of a preferred embodiment of the present invention, first on drive surface 27 is suitably formed substantially vertically (perpendicular) relative to first circular top 22. However, according to various alternative aspects with momentary reference to FIG. 4, first on drive surface 27 may be oriented at an angle relative to first circular top 22 such that, again as will be described in more detail below, first on drive surface 27 more readily facilitates the application of cap assembly 10 by engagement with outer cap 30.

Figure 5B:
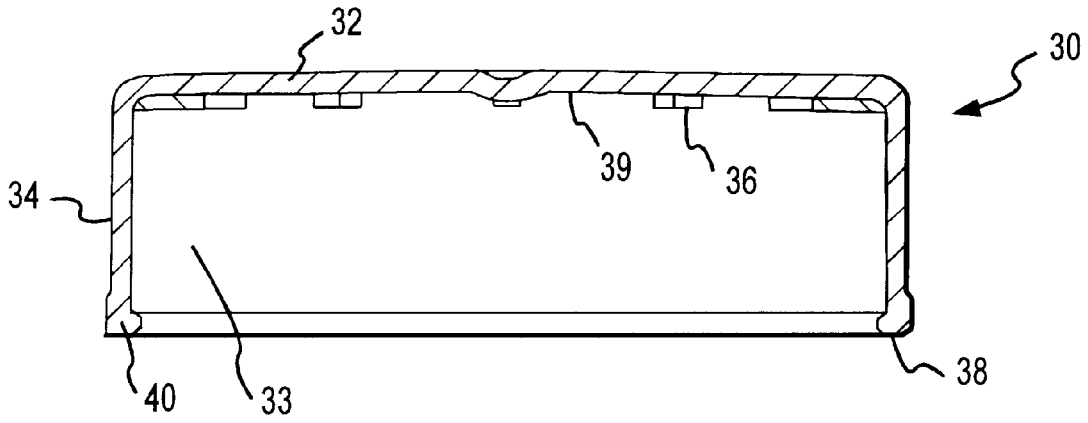
FIG. 5*b* is a cross-sectional side view of an outer cap of a child-resistant cap assembly.
Figure 5A:
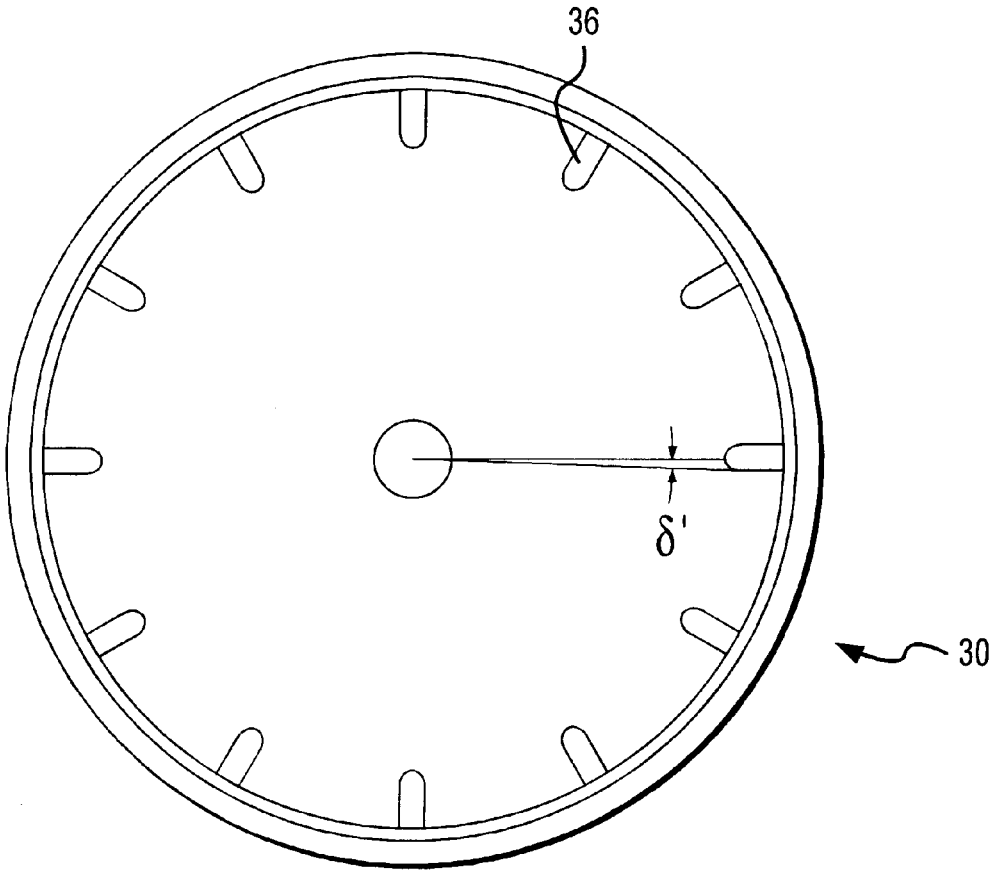
FIG. 5*a* is a bottom view of an outer cap of a child-resistant cap assembly.

With reference now to FIG. 5, according to an exemplary embodiment of the present invention, outer cap 30 is suitably comprised of a second circular top 32 and a second annular sidewall 36. In accordance with this embodiment, outer cap 30 is suitably configured to retain inner cap 20 such that outer cap 30 and inner cap 20 are freely rotatable relative to each other. For example, in accordance with a preferred embodiment of the present invention, inner cap 20 is suitably retained in outer cap 30 by a retaining mechanism 40 such as an annular lip formed on an inside surface 33 and proximate to a lower edge 38 of second sidewall 34, though inner cap 20 may be retained in outer cap 30 by any other suitable retaining mechanism 40. For example, inner cap 20 may be retained in outer cap 30 by structures such as, among others, skirts, webs, flaps and the like.

In addition, the location of retaining mechanism 40 may vary with alternative embodiments of the present invention, such as, for example, locating retaining mechanism 40 away from lower edge 38 or on a lower surface 39 of second circular top. Preferably, lip 40 suitably extends the entire circumference of second sidewall 36. However, according to various alternative aspects of the present embodiment, lip 40 may extend only partially or in segments around the circumference of second sidewall 36.

With continuing reference to FIG. 5, in accordance with an exemplary embodiment of the present invention, outer cap 30 is suitably configured with at least one lug 36. Preferably, outer cap 30 is configured with the same number of lugs 36 as inner cap 20 has ramps 26 though any number or configuration of lugs 36 and projections may be suitable. Thus, in the present exemplary embodiment, as inner cap 20 has twelve ramps 26, outer cap 30 is suitably configured with twelve lugs 36. Additionally, lugs 36 are suitably located on lower surface 39, though according to various aspects and alternative embodiments of the present invention, lugs 36 may be located on various other surfaces of outer cap 30 such as an inner surface 33 of second annular sidewall 34.

In accordance with a preferred embodiment of the present invention, lugs 36 are suitably located to correspond and engage with ramps 26. In this embodiment, ramps 26 are located annularly at evenly spaced intervals, in proximity to outer edge of first circular top 22. Accordingly, lugs 36 should similarly be located as such to correspond to ramps 26, i.e., annularly at evenly spaced intervals, in proximity to an outer edge 35 of second circular top 32.

Figure 6A:
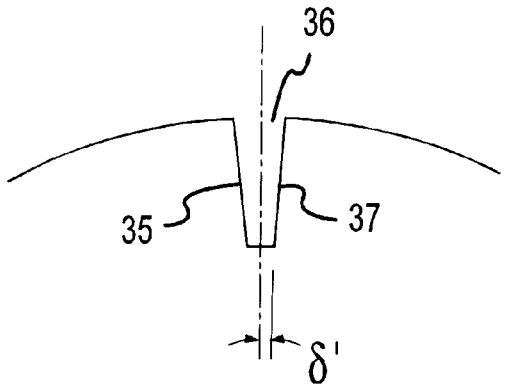
FIG. 6*a* is a top view of a lug of a child-resistant cap assembly.
Figure 6B:
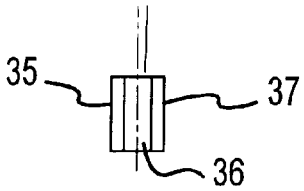
FIG. 6*b* is a side view of a lug of a child-resistant cap assembly.

Referring now to FIG. 6, in a preferred embodiment of the present invention, lugs 36 are suitably configured with a second off drive surface 35 and a second on drive surface 37. In the present exemplary embodiment, second sliding 35 surface of lugs 36 suitably corresponds to first off drive surface 25 of ramps 26 such that lug 36 and corresponding ramp 26 engage by line or surface-to-surface contact. That is, throughout the relative rotation of inner cap 20 and outer cap 30, lug 36 remains in contact with ramp 26, not by merely point contact, but by radial contact across ramp 26. Similarly, second on drive surface 37 of lug 36 suitably corresponds to first on drive surface 27 of ramps 26.

According to one aspect of the present invention, second off drive surface 35 suitably corresponds to first off drive surface 25 by being formed by a second complex angle $\alpha'$. Second complex angle $\alpha'$ is suitably formed by a third angle $\delta'$ and a fourth angle $\beta'$. Third angle $\delta'$ is substantially equivalent to second angle $\delta$ and fourth angle $\beta'$ substantially corresponds to first angle $\beta$ such that radial contact is maintained between lug 36 and ramp 26 throughout the range of relative motion of lug 36 and ramp 26. Accordingly, at any point of relative rotation across first off drive surface 25 and second off drive surface 35 between inner cap 20 and outer cap 30, lugs 36 remain in line or surface to surface contact radially across ramp 26 rather than by merely point contact.

Figure 7:
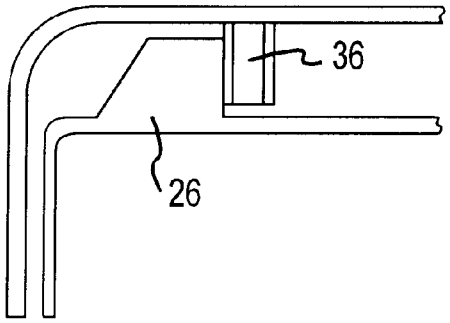
FIG. 7 is a side view of a lug engaging a ramp while fastening a child-resistant cap assembly.

For example, in accordance with one aspect of this embodiment and with reference to FIG. 7, fourth angle β' is suitably formed as an acute angle with respect to a bottom surface 39 of outer cap 30 such that second off drive surface 35 remains in surface-to-surface contact with first off drive surface 35.

Now, with reference back to FIG. 6, in the illustrated embodiment, second on drive surface 37 is suitably formed substantially vertical relative to second circular top 32. Again however, according to alternative embodiments of the present invention, as the angle of first on drive surface 27 varies, the angle of second on drive surface 37 should vary correspondingly.

It should be noted, however, that many alternative embodiments of cap assembly 10 which suitably provide for substantially radial contact between caps 20,30 of the cap assembly 10 and suitably remain child-resistant while remaining senior-friendly, may be apparent to one skilled in the art. All of such embodiments fall within the scope and spirit of the invention.

Figure 8A:
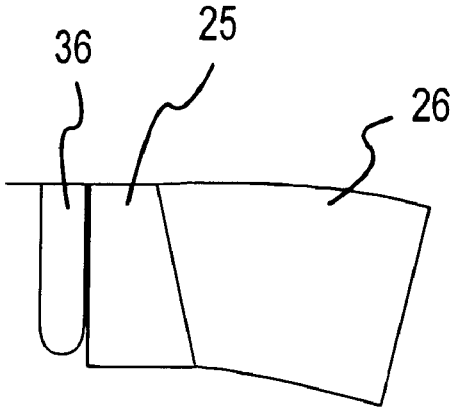
FIG. 8*a* is a side view of a lug sliding over a ramp while attempting to unfasten a child-resistant cap assembly.

With reference now to FIG. 8, the operation of the illustrated embodiment of cap assembly 10 follows. As outer cap 30 is rotated in a "fastening" direction, outer cap 30 begins to rotate freely from inner cap 20. As outer cap 30 continues to rotate, second on drive surface 37 of lug 36 contacts first on drive surface 27 of ramp 26 in substantially surface-to-surface contact. Throughout the rotation of outer cap 30, lug 36 remains in surface-to-surface contact across lug 36 and ramp 26. The continued rotation of outer cap 30 causes inner cap 20 to rotate in tandem with outer cap 30, thus fastening cap assembly 10 to the container.

Figure 8B:
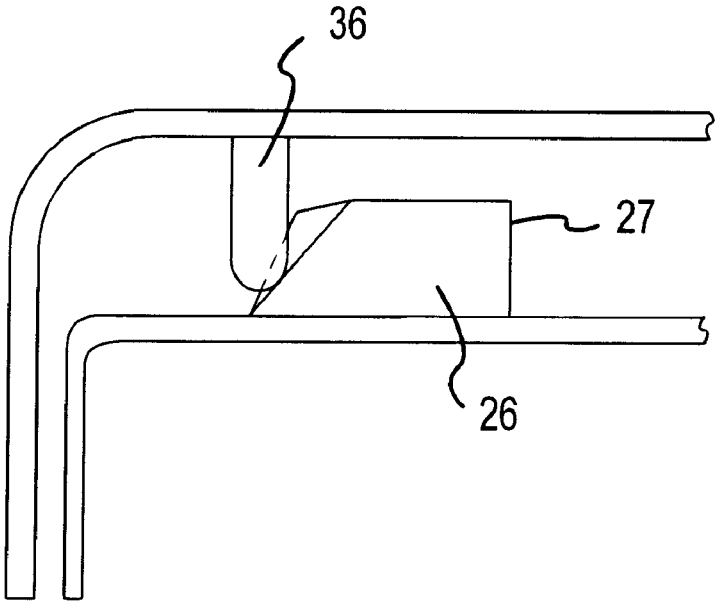
FIG. 8*b* is a side view of a lug engaging a ramp while unfastening a child-resistant cap assembly.

Now, with reference to FIG. 8*b,* as outer cap 30 is rotated in an "unfastening" direction, outer cap 30 again begins to rotate freely. As outer cap 30 continues to rotate, second off drive surface 35 of lug 36 contacts first off drive surface 25 of ramp 26, in, as described above, "line" or "surface-to-surface" contact.

However, when outer cap 30 is merely rotated in the unfastening direction, second off drive surface 35 of lug 36 slides over first off drive surface 25 of ramp 26. Inner cap 20 and outer cap 30 thus do not turn in tandem, and cap assembly 10 remains fastened to the container, thereby making cap assembly 10 child-resistant. In order to remove cap assembly 10, downward force is applied to cap assembly 10 in order to counteract the sliding tendency of lugs 36 over ramps 26.

However, in accordance with this embodiment of the present invention, the line or surface-to-surface contact means less torque and/or downward force is required to remove cap assembly 10. Cap assembly 10 thus has the benefit that assembly 10 remains child-resistant, yet is substantially more senior-friendly.

For example, in tests of cap assembly 10 embodying the present invention, surprising and unexpected results were obtained. In tests of cap assembly 10, packages sealed by cap assembly 10 were provided to ten seniors and ten children. The respective groups were told to open the packages and timed while doing so. For the senior group, the first attempt at opening was performed on a package which had never been opened. Such a test is significant since packages which have not been previously opened generally tend to require greater amounts of force to open. If the senior test subject is successful at the first opening, the same test subject then re-seals the package and is asked to open the package again. However, in contrast, in the child test group, the children are only given packages which have been re-sealed by seniors. This is significant because seniors and children generally do not refasten cap assemblies to the package as tightly as the caps are torqued before having been previously opened.

The following tables show that, with respect to the present embodiment of cap assembly 10, seniors are quite successful at opening cap assembly 10, usually in a matter of seconds, while not a single child could successfully open cap assembly 10 within five minutes on a first attempt. In addition, no child test subject was able to remove cap assembly 10 which had been removed and re-fastened by a senior within five minutes on a second attempt.

Child Test Package Results

| Age (in Months) | First Attempt at Opening (no demonstration) | Second Attempt at Opening (with demonstration) |
|---|---|---|
| 51 | 301 (fail) | 301 (fail) |
| 47 | 301 (fail) | 301 (fail) |
| 51 | 301 (fail) | 301 (fail) |
| 51 | 301 (fail) | 301 (fail) |
| 46 | 301 (fail) | 301 (fail) |
| 44 | 301 (fail) | 301 (fail) |
| 46 | 301 (fail) | 301 (fail) |
| 42 | 301 (fail) | 301 (fail) |
| 45 | 301 (fail) | 301 (fail) |
| 44 | 301 (fail) | 301 (fail) |

Senior Test Package Results

| Age (in Years) | First Opening (fail = 301 seconds) | Second Opening (fail = 61 seconds) |
|---|---|---|
| 68 | 14 seconds | 6 seconds |
| 66 | 9 seconds | 2 seconds |
| 60 | 3 seconds | 3 seconds |
| 70 | 9 seconds | 6 seconds |
| 69 | 25 seconds | 9 seconds |
| 68 | 13 seconds | 3 seconds |
| 69 | 1 second | 5 seconds |
| 66 | 6 seconds | 3 seconds |
| 70 | 11 seconds | 5 seconds |
| 67 | 3 seconds | 5 seconds |

Thus, as illustrated above, cap assembly 10 effectively prevents children from removing cap assembly 10, yet remains senior-friendly, allowing seniors to remove cap assembly 10 without substantial difficulty.

Finally, the above described embodiment are merely illustrative of particular embodiments of the invention, and, as mentioned above, many alternative embodiments of cap assembly 10 may provide for substantially radial contact between caps 20,30 of the cap assembly 10 and suitably remain child-resistant while remaining senior-friendly. Accordingly, it many modifications of structure, arrangement, proportions, the elements, materials and components, used in the practice of the invention and not specifically described may be varied and particularly adapted for a specific applications and operating requirements, all without departing from the scope and spirit of the invention.

I claim:

1. A child-resistant cap assembly, comprising:

an inner cap with at least one inner cap projection having a complex angled surface; and an outer cap, wherein said outer cap has a retaining mechanism which engages said inner cap such that said inner cap and said outer cap are freely rotatable relative to each other, and wherein said outer cap has at least one outer cap projection, wherein said outer cap projection and said inner cap projection engage by radial contact over a length on said complex angled surface when unfastening the cap assembly.

2. A cap assembly according to claim 1, wherein said inner cap projection has a first off drive surface and a first on drive surface and said outer cap projection has a second off drive surface and a second on drive surface, wherein said first off drive surface corresponds to said second off drive surface and said first on drive surface corresponds to said second on drive surface.

3. A cap assembly according to claim 1, wherein said inner cap projection and said outer cap projection engage by radial contact in the form of line contact.

4. A cap assembly according to claim 1, wherein said inner cap projection and said outer cap projection engage by radial contact in the form of surface to surface contact.

5. A cap assembly according to claim 1, wherein said retaining mechanism is an annular lip.

6. A child-resistant cap assembly, comprising:

an inner cap, wherein said inner cap has a ramp having a first off drive surface formed as a first complex angle; and an outer cap, wherein said outer cap has a lug having a second off drive surface configured to engage said first off drive surface of said ramp by radial contact over a length on said first off drive surface, wherein said outer cap has a retaining mechanism which rotatably retains said inner cap.

7. A cap assembly according to claim 6, wherein said lug engages said ramp by radial contact in the form of line contact.

8. A cap assembly according to claim 6, wherein said lug engages said ramp by radial contact in the form of surface to surface contact.

9. A cap assembly according to claim 6, wherein said retaining mechanism is an annular lip.

* * * * *